United States Patent [19]

Umezawa et al.

[11] Patent Number: 4,891,064

[45] Date of Patent: Jan. 2, 1990

[54] METHOD OF MELTING COLD MATERIAL INCLUDING IRON

[75] Inventors: Kazushige Umezawa; Tatsuro Kuwabara; Tetsuya Oh-hara; Tsuzuru Nuibe; Kousaku Ozawa, all of Himeji, Japan

[73] Assignee: Nippon Steel Corporation, Tokyo, Japan

[21] Appl. No.: 306,176

[22] Filed: Feb. 6, 1989

[30] Foreign Application Priority Data

Sep. 30, 1988 [JP] Japan ..... 63-247121

[51] Int. Cl.[4] ..... C21C 7/00

[52] U.S. Cl. ..... 75/51.2; 75/49; 75/51.5

[58] Field of Search ..... 75/51.5, 51.2, 49

[56] References Cited

U.S. PATENT DOCUMENTS 3,844,768 10/1974 Leroy ..... 75/49

4,430,117 2/1984 Spenceley ..... 75/51.5

4,537,629 8/1985 Lazcano-Navarro ..... 75/51.2

*Primary Examiner*—Peter D. Rosenberg

*Attorney, Agent, or Firm*—Pollock, Vande Sande & Priddy

[57] ABSTRACT

A method of melting an iron-containing cold material and simultaneously obtaining a low phosphorous and high carbon molten iron while maintaining a high post combustion rate, comprising the steps of: preparing a converter having a lance for top-blowing oxygen, and a bottom-blowing triple pipe nozzle disposed at a bottom of the converter which nozzle is provided with an inner pipe, an intermediate pipe and an outer pipe; supplying the iron-containing cold material into the converter in which a hot heel exists; introducing into the converter all of a carbonaceous material together with a non-oxidizing gas through the inner pipe of the triple pipe nozzle, oxygen through a space defined between the inner pipe and the intermediate pipe, and a non-oxidizing cooling gas through another space defined between the intermediate pipe and the outer pipe, and additional oxygen through the oxygen top-blowing lance so that the cold material is melted into a molten iron under an existence of slag; maintaining both the content of carbon dissolved in the molten iron at a level of 3 to 4% in most of a period of time for the melting and the rate of bottom-blown oxygen in a range of not less than 10% but less than 20% of the total amount of the oxygen; and adding intermittently or successively iron oxide into the slag in most of a melting period of time while keeping a slag basicity defined by $CaO/SiO_2$ in a range of 1.5 to 3.0.

7 Claims, 7 Drawing Sheets

METHOD OF MELTING COLD MATERIAL INCLUDING IRON

BACKGROUND OF THE INVENTION

The present invention relates to a method of melting a cold material including iron and simultaneously obtaining high carbon and low phosphorous molten iron while keeping a high post combustion rate.

In Japanese Patent Unexamined Publication No. 60-174812 there is disclosed a converter steel-making method comprising: in the first step iron-containing cold material, carbonaceous materials and oxygen are supplied into a converter containing hot metal, called "hot heel", and high carbon molten iron is obtained in the second step the molten iron obtained in the first step is refined by oxygen blowing in another converter, and molten steel with a desired temperature and chemical composition is obtained.

The temperature of the above-mentioned molten iron in the first step is preferably 1450° C. or lower for the purpose of minimizing a melting loss of a refractory material during the melting. In order to keep a heat source in the second step, the carbon content in the melt needs to be 3.0% or more, preferably 3.5% or more.

Another method of melting a cold material containing iron is disclosed in Japanese Patent Examined Publication No. 56-8085. This method for melting the cold material is effected by use of a converter 15 having, as shown in FIG. 1, an oxygen top-blowing lance 14 and a triple pipe nozzle 1 shown in FIGS. 1 and 2. In this method, there are fed iron-containing cold charge 17 such as scrap, sponge iron, pellet, solid pig iron and/or iron ore into the converter 15 in which a hot heel 16 such as pig iron is previously retained. Then, as shown in FIGS. 2 and 3, by use of a non-oxidizing gas such as nitrogen gas there is introduced through an inner pipe 2 of the triple pipe nozzle 1 a carbonaceous material such as coal powder or coke powder. Oxygen is simultaneously introduced into the converter through an intermediate pipe 3, while non-oxidizing gas such as LPG is also introduced through an outer pipe 4. As a result of the blowing, the carbonaceous material is dissolved in the bath so that a primary combustion ($C+(\frac{1}{2})O_2 \rightarrow CO$) of the carbon in the bath occurs, and oxygen is further supplied through an oxygen top-blowing lance 14 so as to effect the post combustion ($CO+(\frac{1}{2})O_2 \rightarrow CO_2$) of CO. As a result of this, heat is supplied to the bath and the cold material is melted to obtain molten iron.

In FIGS. 2 and 3, reference numeral 7 represents projections provided on the outer periphery of the inner pipe 2 with the same interval while projections extend in the direction of the axis of the inner pipe. Each of the outer surfaces of the projections 7 is in contact with the inner periphery of the intermediate pipe 3 so as to form a gap 5. Reference numeral 8 represents projections provided on the outer periphery of the intermediate pipe 3 with the same interval which projections extends along an axis of the intermediate pipe. Each of the outer surfaces of the projections 8 is in contact with the inner periphery of the outer pipe 4 so as to form a gap 6. Reference numeral 9 represents a steel shell of the furnace body, and reference numeral 10 represents a refractory member provided on the inner periphery of the furnace body.

In this method of melting the iron-containing material, a post combustion is essential because the amount of raw materials such as carbonaceous material and oxygen used in the method of melting the iron-containing material such as steel scrap is, as shown in FIG. 4, determined by the rate of the post combustion. Therefore, the higher the post combustion rate is, the smaller the amount of the carbonaceous material and oxygen is when melting the iron-containing cold material.

According to the Japanese Patent Examined Publication No. 56-8085, a high post combustion rate can be obtained by a process having the steps of: disposing the oxygen top-blowing lance 14 so that the lance 14 is spaced apart 2 m or more from the surface of a bath; supplying oxygen of a free jet state from the level of 2 m or higher above the bath surface; and controlling the rate of bottom-blown oxygen in a range of 20 to 80% (the rate of the oxygen to be blown through the top-blowing lance 14 is 80 to 20%.) If the rate of the bottom-blown oxygen is less than 20%, there occurs the foaming of slag, which causes the space providing a free jet above the bath surface, to be reduced. As the result of foaming, a high post combustion rate cannot be obtained.

Although in the last-mentioned prior art method a, desulfuration reaction can be progressed in the converter during melting, a dephosphorization reaction, which is a oxidation reaction, cannot be progressed. Therefore, most of the phosphor contained in the raw materials is included in the molten iron. Therefore, a dephosphorization needs to be performed by use of slag for dephosphorization at the time of performing decarburization in a next decarburizing furnace.

On the other hand, the rate of bottom-blown oxygen is essential with respect to the both apparatus and operating cost. The lower the rate of the bottom-blown oxygen is, the simpler the bottom blowing equipment is (the number of the nozzles can be reduced), and the cost needed for the bottom-blowing equipments can be also reduced. Furthermore, the smaller the rate of the bottom-blown oxygen is, the smaller the amounts of non-oxidation cooling gas such as LPG and a protection gas such as $N_2$ or Ar supplied for the purpose of preventing the clogging of oxygen-blowing nozzle is, so that an operation cost can be reduced.

On the other hand, since the bottom refractories of a furnace is apt to be readily damaged as the stirring force induceed to the bath becomes large, it is desired to reduce the rate of the bottom-blown oxygen so as to minimize the loss or damage of the refractories.

Japanese Patent Unexamined Publication No. 57-164908 discloses the same object as in the above-described Japanese Patent Examined Publication No. 56-8085, in which only the rate of bottom-blown oxygen is reduced to be not more than 20%, but other conditions are made to be similar to those of the Publication 56-8085. However, the mere reducing of the rate of the bottom-blown oxygen causes problems concerning the operation such as slag-foaming. In the method disclosed in the Japanese Patent Unexamined Publication No. 57-164908, no measure is taken to solve the problems, and a method of melting cold iron-containing material in which method the rate of oxygen blown from bottom is reduced to be not more than 20% is not realized. Furthermore, in the Publication No. 57-164908, there is no teaching for obtaining molten iron in which phosphor content is reduced, which reducing of phosphorus is one of the main object of the present invention.

Also in AIME annual meeting (March, 1987), there was disclosed a method of manufacturing steel comprising a first step in which iron-containing material is melted and a second step in which a high carbon molten iron prepared in the first step so as to be used as a raw material is refined by oxygen-blowing in another converter to thereby obtain molten steel of a desired temperature and composition. In this method, low phosphorous or low sulfur and high carbon molten iron is obtained in the first step so as to effect the second step without any dephosphorizing treatment or with a slight degree of dephosphorizing treatment to thereby obtain a merit of a slag-free refining. Regarding the conditions for achieving the above-object, the method discloses such matter that a slag containing a high rate of CaO is be provided under a condition that [C] is 3.5 to 4% at a temperature of 1400° to 1450° C. after the refining has been performed. Furthermore, the method discloses that it is preferable to make the temperature low at the time of refining. In addition, the conditions which enables the dephosphorization and desulfurization to be progressed sufficiently is considered in the method. According to the method, it is important to make slag having a melting point higher than the refining temperature, that is, it is important to make a solid state slag. In order to achieve this, the slag is made to have a composition in which the content of CaO is larger than the content of $SiO_2$, that is, the slag is made to have a high basicity ($CaO/SiO_2$). In order to obtain $(P_2O_5)/[P]=100$ at the final stage of the method, the slag composition is made to have $CaO/SiO_2 \div 4$.

In the operating conditions described regarding the prior art method, the following two serious problems arise.

First, if the slag is in a solid state after refining, removal of the slag from the melting furnace becomes impossible or very hard. If the slag is forcedly removed, the molten metal is also discharged with the result that the yield thereof is reduced. Furthermore, if the slag is in a solid state, molten metal is apt to adhere to or penetrate in the slag in a great degree, and the thus adhered metal is discharged with the slag. In this case, the yield is also reduced.

A second problem is that, a great quantity of CaO source needs to be used in order to make the slag having a high value of $CaO/SiO_2$. That is, since a great quantity of $SiO_2$ source exists in a melting furnace due to the carbonaceous materials and its scraps, a great quantity of the CaO commensurate to the former needs to be added.

OBJECT OF THE INVENTION

An object of the present invention is to provide a novel method of melting a cold material containing iron which method ca achieve a high post combustion rate by use of a lower rate of oxygen blown from bottom than the conventional method of melting a cold material containing iron, so that it is possible to reduce all of the cost of equipment for bottom-blowing, a quantity of non-oxidation cooling gas, and a rate of damage or loss of refractories on a furnace bottom, in comparison with prior art and at the same time it is possible to efficiently obtain a high carbon molten iron having a lower content of phosphorous.

A method of the invention for melting an iron-containing cold material and for simultaneously obtaining a low phosphorous and high carbon molten iron while maintaining a high post combustion rate, comprising the steps of:

providing a converter having a lance for top-blowing oxygen, and a bottom-blowing triple pipe nozzle disposed at a bottom of the converter which nozzle is provided with an inner pipe, an intermediate pipe and an outer pipe;

supplying the iron-containing cold material into the converter in which a hot heel exists;

blowing into the converter all of a carbonaceous material together with a non-oxidizing gas through the inner pipe of the triple pipe nozzle, oxygen through a space defined between the inner pipe and the intermediate pipe, and a non-oxidizing cooling gas through another space defined between the intermediate pipe and the outer pipe, and additional oxygen through the oxygen top-blowing lance so that the cold material is melted into a molten iron under an existence of slag;

maintaining both the content of carbon dissolved in the molten iron at a level of 3 to 4% in most of a period of time for the melting and the rate of bottom-blown oxygen in a range of not less than 10% but less than 20% of the total amount of the oxygen; and adding intermittently or successively iron oxide into the slag in most of a melting period of time while keeping a slag basicity defined by $CaO/SiO_2$ in a range of 1.5 to 3.0.

In the method of the invention, the rate of the post combustion and dephosphorization can be further efficiently enhanced by blowing oxygen in a spiral flow state into the molten iron through the triple pipe nozzle.

Furthermore, slag-forming material such as $CaF_2$ or $CaCl_2$ can be partially used as a flux. In addition, an iron ore, pellet, mineral stone containing Mn, milscale, and dust can be used as iron oxide. In particular, the use of dust which is generated in great quantity from the melting furnace will give a further advantage.

DETAILED DESCRIPTION OF PREFERRED EMBODIMENT

Figure 1:
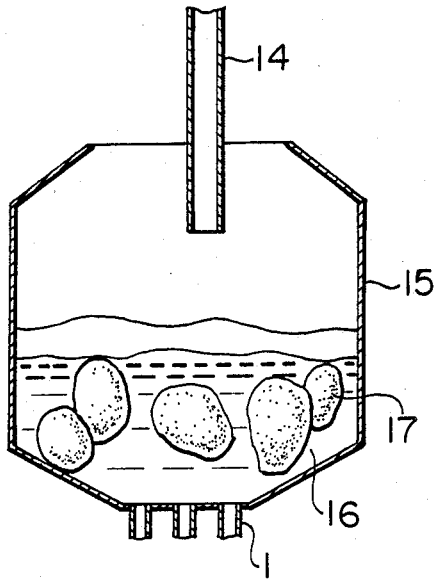
FIG. 1 illustrates a method of melting a iron-containing cold material.
Figure 3:
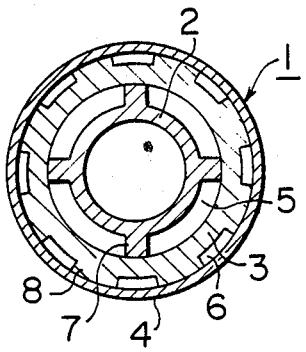
FIGS. 2, 3, and 10 illustrate the structure of a triple pipe nozzle (straight triple pipe nozzle) for use in a conventional method.
Figure 2:
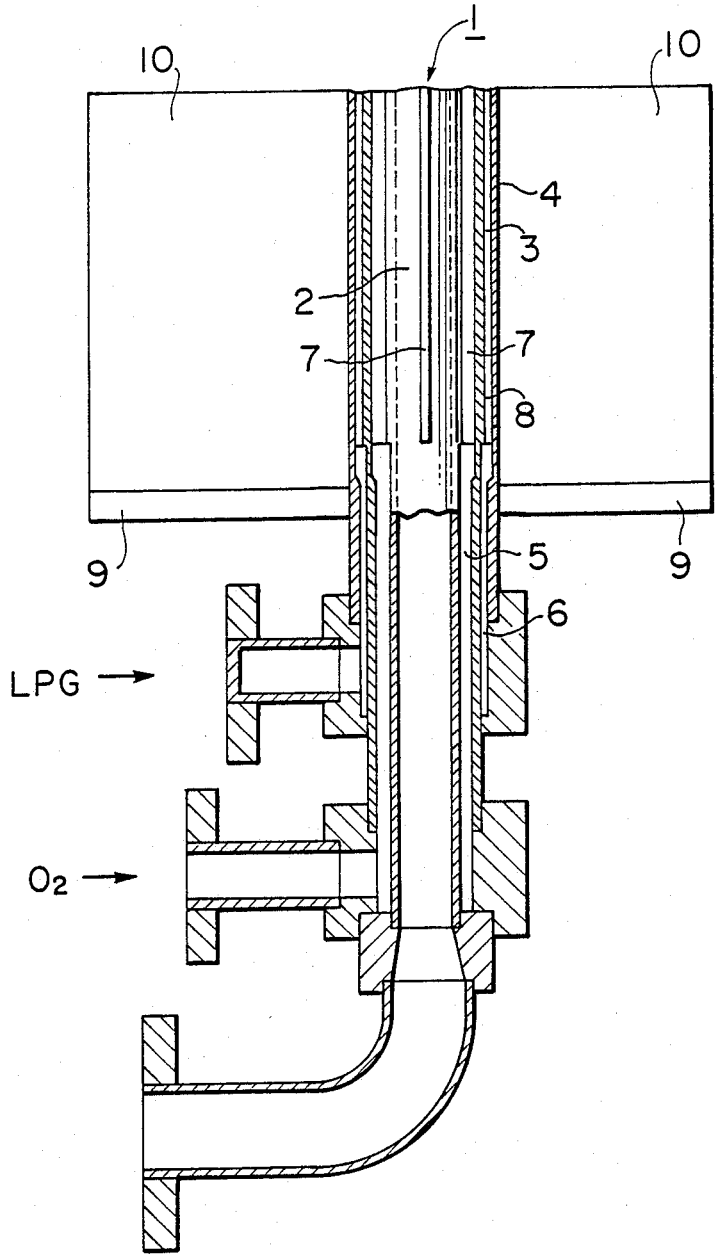
Figure 4:
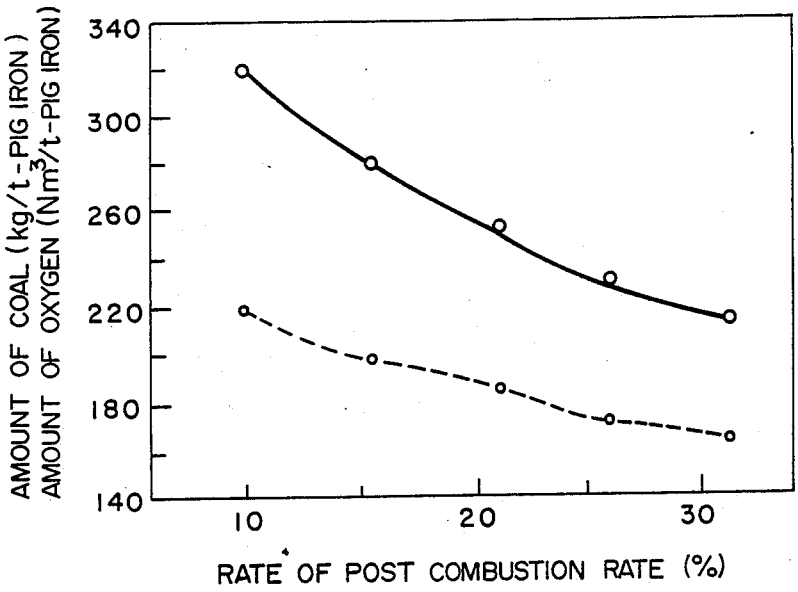
FIG. 4 illustrates the relationship between a post combustion rate and amount of, carbonaceous material or amount of oxygen used in the method of melting the material.

FIG. 1 illustrates an example of the present invention, and FIGS. 2 and 3 illustrate an example of furnace bottom nozzle used in the embodiment of an present invention.

Referring to the drawing, reference numeral 15 represents a converter having a furnace bottom nozzle 1 of a triple pipe type and an oxygen top-blowing nozzle 14. After charging a cold iron source 17 into the converter 15 in which a hot heel is present, there are fed in the converter an oxygen gas, carbonaceous material (with a carrier gas) and cooling non-oxidation gas through the triple pipe nozzle 1 disposed on a furnace bottom. In addition, an oxygen gas is supplied from the oxygen top-blowing lance 14, while iron oxide for dephosphorization is intermittently or successively added from the furnace port of the converter. In such method, by employing the features of the present invention, the iron-including cold material can be efficiently melted and furthermore, a high carbon molten iron 16 having a reduced amount of phosphorous can be obtained.

The structure of the furnace bottom nozzle 1 is as shown in FIGS. 2 and 3. It has an inner pipe 2, intermediate pipe 3, outer pipe 4. A non-oxidation gas such as nitrogen gas used as a carrier gas and a carbonaceous material such as coal powder or coke are supplied from the inner pipe 2. In addition, an oxygen gas is introduced through a gap 5 defined between the inner pipe 2 and the intermediate pipe 3. Furthermore, a non-oxidizing cooling gas such as LPG is introduced through a gap 6 defined between the intermediate pipe 3 and the outer pipe 4.

Referring to the drawings, reference numeral 7 represents a projection for forming the gap 5, and reference numeral 8 represents a projection for forming the slit gap 6. Reference numeral 9 represents a steel shell of the furnace bottom, and reference numeral 10 represents refractories disposed on the inner part of the furnace bottom. Inventors of the present invention conducted the following experiment by using the converter.

That is, both scrap and slag-forming agents were fed two times (the amount of the scrap is 62 tons in total) into a hot heel of 70 tons having [C] of 3.0 to 3.5% and a temperature of 1380° to 1400° C. received in the converter so that a molten iron of about 120 tons having [C] of not less than 3.7% and a temperature of 1400° to 1450° C. may be produced.

In the experiment, the rate of bottom-blown oxygen was changed in a range of 5 to 30% (the rate of top-blown oxygen became 70 to 95%) by changing the number of nozzles disposed on a furnace bottom while the rate of oxygen supplied per one furnace bottom nozzle was fixed to be 5% of the total amount of oxygen. Furthermore, the height of the top-blowing lance was adjusted depending upon the analyzing result of the exhaust gas so that the post combustion rate during the melting was controlled.

As a result, the inventors of the invention discovered the matters shown below about the dephosphorization.

Figure 5:
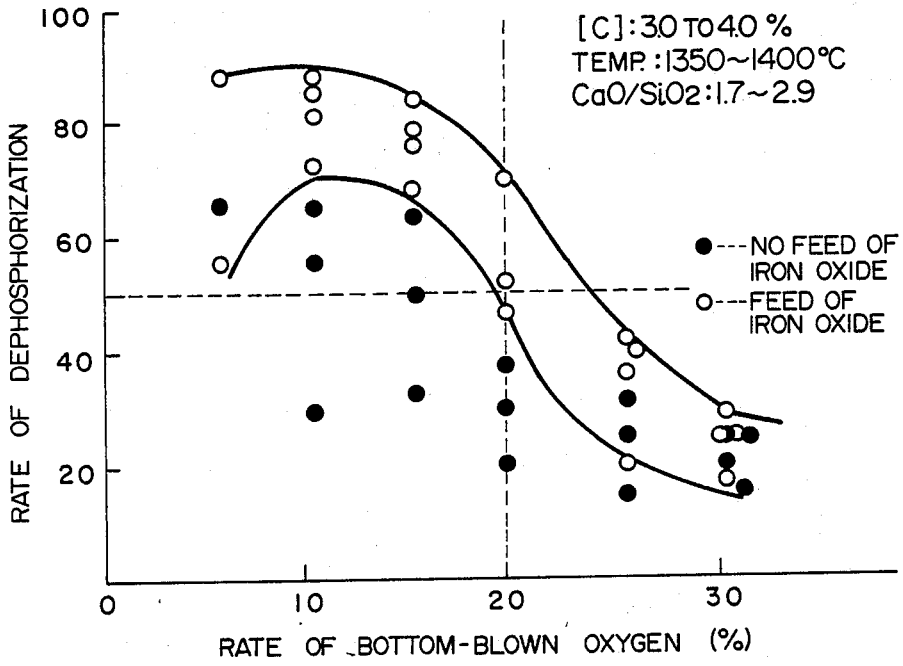
FIG. 5 is a graph showing the relationship between a rate of bottom-blown oxygen and a rate of dephosphorization with respect to each of two cases where iron oxide is added and no iron oxide is added.

In order to proceed with the melting of cold iron-containing material by feeding the carbonaceous material and oxygen while at the same time proceeding with the reaction of dephospherization, there are necessary proper conditions for composition of slag, stirring of bath, the manner of supplying oxygen, composition of the bath, and temperatures. FIG. 5 illustrates the relationship between the rate of dephosphorization and the rate of bottom-blown oxygen (with mark •). The rate of dephosphorization becomes larger as the rate of the bottom-blown oxygen is reduced, that is, as the stirring force applied to the bath becomes reduced. However, the supply of only oxygen gas used as the oxygen source is not sufficient to obtain a sufficient dephosphorization rate, and a variation in the dephosphorization rate becomes larger. As well known, the dephosphorization reaction proceeds as follows:

$$2[P]+5(FeO)+nCaO=(nCao\cdot P_2O_5)+5Fe \quad (1)$$

In a usual steel making method effected by use of a converter, the top-blown oxygen gas oxidizes molten iron to thereby generate FeO; so that the FeO concerning the reaction of the formula (1) can be supplied in a sufficient quantity. In the present invention, since a great quantity of oxygen gas is supplied from an upper portion of a furnace, the generation of FeO for dephosphorization was considered to be supplied sufficiently. However, upon the analysis of the generated slag, the contents of the FeO is, as shown in Table 1, at most 2% even in a case where a rate of bottom-blown oxygen is small. The inventors have noticed that a reason why a sufficient dephosphorization cannot be obtained lies in that the content of the FeO is too low.

| Rate of oxygen to be blown from bottom | Content X (%) of FeO in slag | |
|---|---|---|
| | without iron oxide | iron oxide added (20 kg/t) |
| 20 to 30% | 1.2 | 1.9 |
| <20% | 2.0 | 3.6 |

Thus, in order to raise the content of FeO in the slag, a successive addition of iron oxide was attempted. The amount of the addition of the iron oxide was 20 kg/t, the addition of which iron oxide only makes the feed of oxygen increase at most 2.5% with respect to the total amount of oxygen. The result is shown by mark o in FIG. 5. In particular, the dephosphorization rate becomes not less than 50% in the region of a rate of bottom-blown oxygen less than 20%, and at the same time a degree of variation becomes smaller.

If the rate of bottom-blown oxygen becomes 10% or lower, a moderate reduction in the dephosphorization rate occurs. As shown in Table 1, the use of the iron oxide added in the slag brings about an effect of raising the content of FeO in the slag. However, in a case where the rate of bottom-blown oxygen is high, the reducing reaction rate of FeO in slag is great, with the result that an addition of iron oxide of a small quantity cannot accumulate the sufficient content of FeO to in slag. Since the addition of iron oxide was performed in the invention so as to maintain the FeO level in the slag, FeO needs to be introduced during the phosphorization reaction at least intermittently or preferably successively. That is, the FeO addition effected only in an initial stage of the melting cannot bring about any advantage.

As a result of the examination of the generated slag, it is found that such addition of iron oxide is effective not only to raise the content of FeO in the slag but also to improve the slagging of lime. Since the temperature of the bath during the melting is less than 1400° C. which is relatively low, the added lime is apt to remain in the slag without complete slagging, so that it thereby does not contribute to the reaction. As described above, although most of the oxygen source is supplied in the state of an oxygen gas in this process, the dephosphorization can be significantly improved by addition of iron oxide of a small quantity because of the quick lime-slagging promoting of the added iron oxide as well as the maintaining of FeO at a relatively high value. In order to accelerate the slagging, the addition of slagging-accelerating flux such as $CaF_2$ or $CaCl_2$ is, of course, effective.

Figure 6:
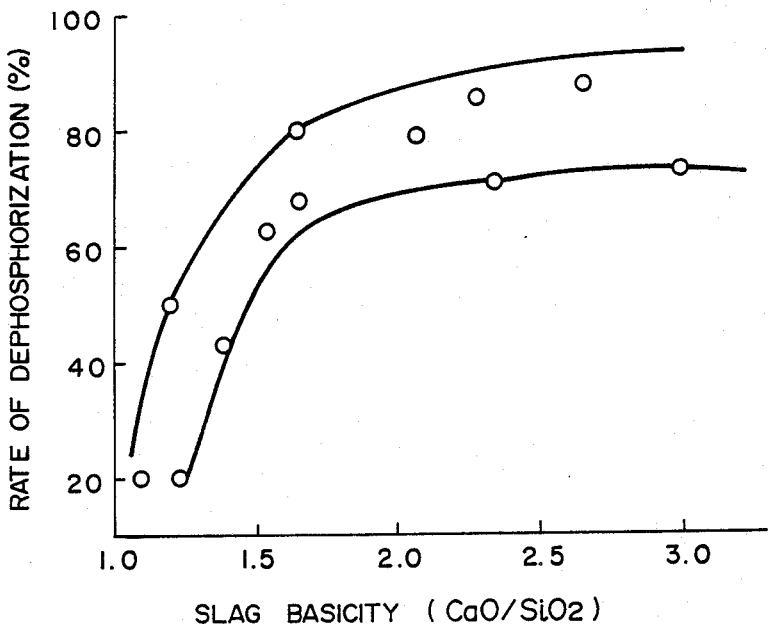
FIG. 6 is a graph showing the relationship between the value of basicity of slag and the rate of dephosphorization.

Next, a result of examination of the influence of the basicity ($CaO/SiO_2$) upon the dephosphorization rate under a condition where the rate of bottom-blown oxygen is 15% is shown in FIG. 6. Because of both the low rate of bottom-blown oxygen and employment of successive addition of iron oxide, the reduction in the dephosphorization is small until $CaO/SiO_2$ reaches 1.5, so that it becomes possible to greatly reduce the amount of lime used in the melting. The upper limit of $CaO/SiO_2$ is 3.0. If the basicity exceeds 3.0, most of the lime in the slag will remain without slagging, causing the lime to be wasted, and in addition, the slag will be solidified, so that operative problems will be apt to occur.

The amount of iron oxide used as a dephosphorization agent is preferable to be 10 to 100 kg per ton of molten iron. If the same is less than 10 kg/t-molten iron, a desired high dephosphorization rate cannot be obtained, while if the same exceeds 100 kg/t-molten iron, the dephosphorization will not be further improved, further, loss of refractory material will be increased and slag foaming will occur. Therefore, the upper limit of the same needs to be a value not more than 100 kg/t-molten iron. The most preferable amount thereof is 10 to 50 kg/t-molten iron.

On the other hand, in the above-described dephosphorization test, if the content of [C] exceeds 4%, a high dephosphorization rate cannot be obtained. The reason for this lies in that, if [C] exceeds 4%, the carbonaceous material injected from the furnace bottom into the molten iron bath cannot be sufficiently dissolved in the bath, with the result that the carbonaceous material undissolved is trapped in the slag, causing the reducing reaction of the slag to occur, so that the value of FeO in the slag decreases to make the dephosphorization insufficient.

In view of these results, inventors have noticed that conditions for making dephosphorization reaction progress while melting the cold iron source is such that the rate of bottom-blown oxygen is limited to be less than 20% while making a slag having the slag basicity of 1.5 to 3.0 together with the addition of iron oxide in the slag. However, another object of the method of the invention for melting cold iron source is to achieve a high post combustion rate to thereby reduce the amount of the carbon material and oxygen used in the method.

Figure 7:
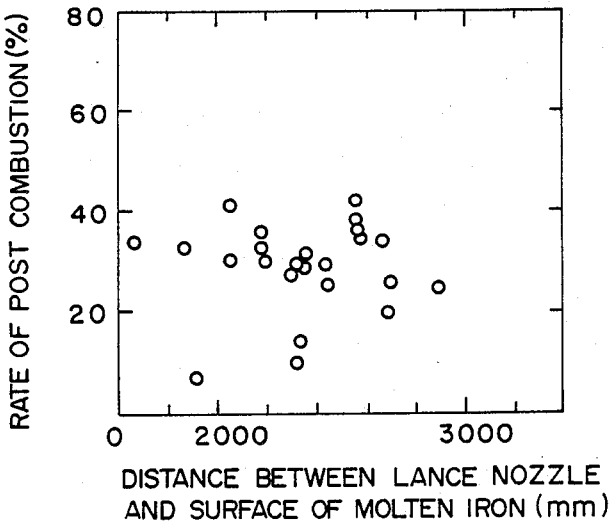
FIG. 7 is a graph showing the relationship between a distance from a lance nozzle to the bath surface and the post combustion rate.
Figure 8:
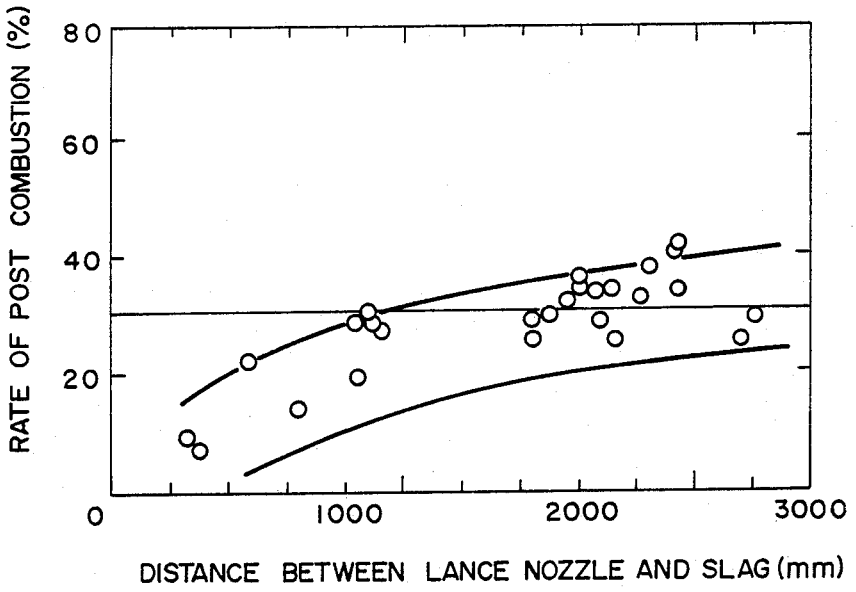
FIG. 8 is a graph illustrating the relationship between a distance from the lance nozzle to slag surface and the post combustion rate.

The relationship between the height of the lance and the post combustion rate is show in FIG. 7. As can be clearly seen from FIG. 7, variations in the post combustion rate are great. Thus, only by adjusting the height of the lance, it is not sufficient to control the post combustion rate. As a result, there occur a great number of cases in which the aimed post combustion rate of 30% cannot be obtained. On the other hand, the height of the slag foaming was measured by sub-lance measurement during melting. The relationship between the distance from the front end of the lance and the slag surface and the post combustion rate can be shown in FIG. 8. That is, the post combustion rate depends upon the free jet length of oxygen supplied from the lance. If the free jet length becomes shorter due to the foaming of the slag, a high post combustion rate cannot be obtained even by raising the lance. This concept is also disclosed in the Japanese Patent Examined Publication No. 56-8085.

Figure 9:
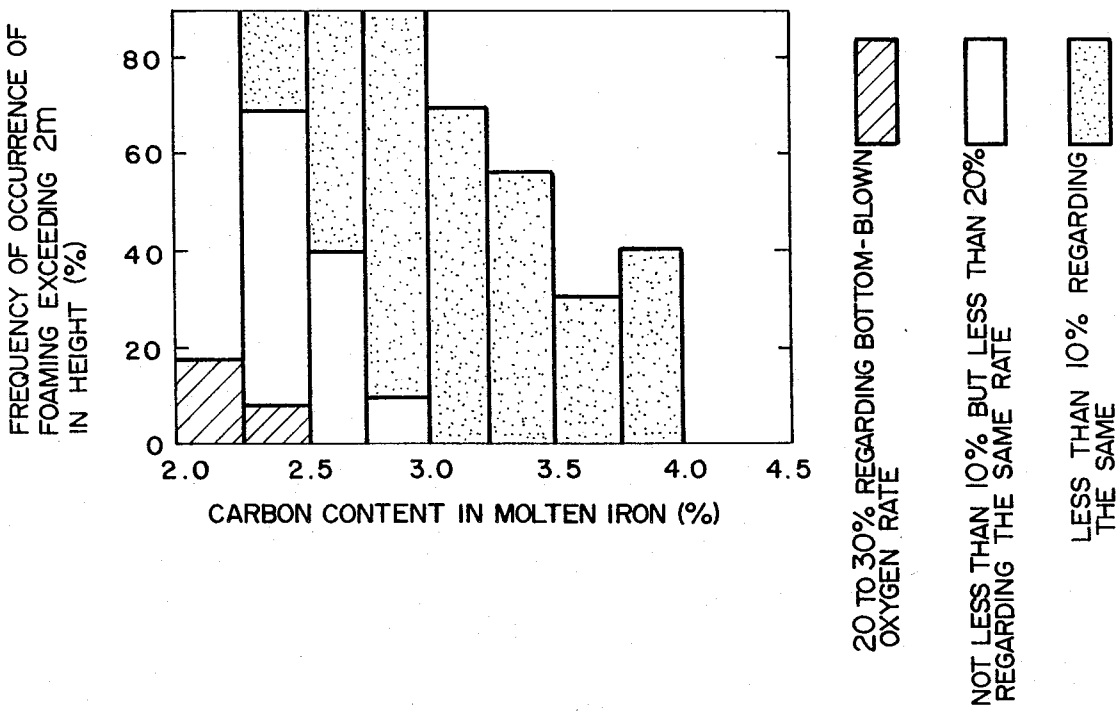
FIG. 9 is a graph showing a relation between the carbon content dissolved in a molten iron (shown as "[C]") and the frequency of occurrence of foaming exceeding 2 m in height with respect to each of the rates of bottom-blown oxygen.

Thus, inventors of the present application again investigated the relationship between the height of slag foaming and the operating conditions, resulting in that the content of [C] in the molten iron has a close relationship with the slag foaming height in addition to the rate of bottom-blown oxygen. FIG. 9 illustrates the relationship between the frequency of such occurrence that the slag foaming height becomes more than 2 m from the molten iron surface, the rate of bottom-blown oxygen, and the content of [C]. As can be clearly seen in FIG. 9 slag foaming hardly occurs in the relatively low content region of [C] when the rate of bottom-blown oxygen is in a range of 20 to 30%. However, it was found that, if the rate of bottom-blown oxygen becomes in a range of 10 to less than 20%, no slag foaming occurs when [C] is retained at 3.0% or more. On the other hand, if the bottom-blown oxygen rate becomes less than 10%, it is impossible to control the slag foaming height even if the content of [C] is controlled.

On the other hand, in a practical operation of the converter, the actual limit of the lance height is 4 to 5 m from the molten iron surface. If the foaming height can be limited to 2 m or less, a free jet space of 2 to 3 m can be obtained. However, if the foaming height exceeds 2 m, the free jet space becomes smaller, so that it becomes hard to obtain a desired post combustion rate.

As shown above, in order to obtain a high and stable post combustion rate by keeping a slag foaming of a low level while the rate of bottom-blown oxygen is maintained to be less than 20% for achieving dephosphorization, it is essential to control [C] in the molten bath in addition to controlling of the bottom-blown oxygen rate.

Thus, the inventors have found the following requirements from many experiments effected in a large scale similar to that of an actual industry.

(1) In order to keep the slag forming height less than 2 m during a substantial period of time of the melting to thereby obtain a high post combustion rate with respect to a case where the rate of bottom-blown oxygen is less than 20%, it is necessary to keep the amount of [C] not less than 3% during a most period of the melting process.

The lower limit of the rate of bottom-blown oxygen is 10%. If this rate is lower than 10%, it becomes impossible to control the slag foaming height by any way.

(2) In order to efficiently perform dephosphorization by keeping a high level of FeO in the slag, it is necessary to restrict the rate of bottom-blown oxygen to a range of less than 20%, and to successively or intermittently introduce iron oxide of 10 to 100 kg/t-molten iron (preferably 10 to 50 kg/t-molten iron) from an upper part of the converter during the melting while keeping the content of [C] in the molten iron to be not more than 4%.

(3) By adopting these conditions, dephosphorization can be performed by use of a slag having both a good fluidity and a slag basicity $CaO/SiO_2$ of 1.5 to 3.0 (preferably 1.7 to 2.5), with the result that the amount of flux material such as lime can be reduced and the yield of iron can be improved.

It is preferable to adopt a low temperature for the molten iron bath in view of improving dephosphorization, and it is preferable to be 1400° C. or lower.

Figure 10:
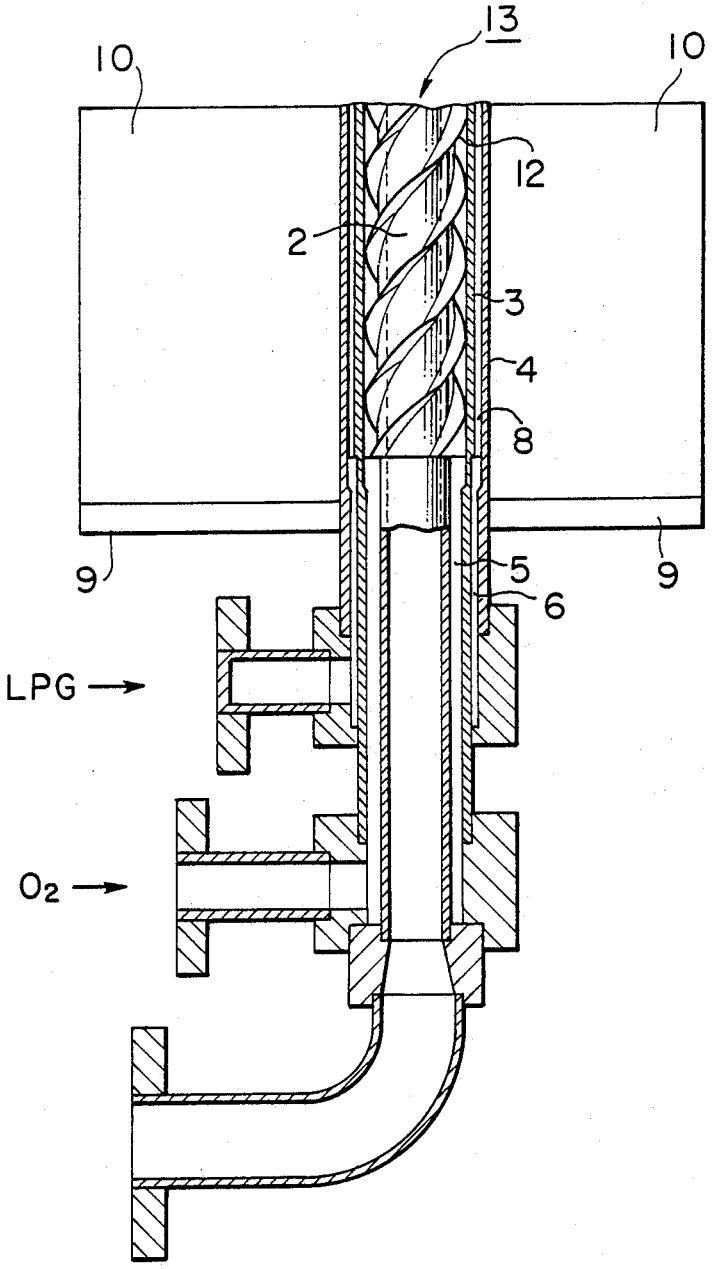

FIG. 10 illustrates an example of a triple pipe nozzle constituted in such a manner that a spiral movement is applied to oxygen and is then bottom-blown into molten iron bath through the nozzle. In the example of FIG. 10, instead of the straight projections 7 used in the nozzle of FIGS. 2 and 3, a spiral guide member 12 is provided in the nozzle.

According to the triple pipe nozzle shown in FIG. 10, the bottom-blown oxygen can be more widely dispersed into the bath than the prior bottom-blown oxygen having no spiral movement before being fed into the molten iron as shown in FIG. 2 and 3. As result of the wide dispersion of the oxygen, a bottom-blown carbonaceous material can be dissolved in a wide range of the bath, which range is decarburized by oxygen, to thereby raise the temperature with a relatively low carbon and high temperature region being formed in comparison with molten iron portions adjacent thereto. Consequently, it enables the carbonaceous material to be fast dissolved. Furthermore, the carbonaceous material injected into the molten iron bath from the inner pipe 2 is made to follow the above-shown spiral movement, rendering it widely and uniformly dispersed into the molten iron bath, so that the dissolving of the carbonaceous material can be promoted and the carbonaceous material can be prevented from floating on the surface of the bath.

As a result, it can contribute to decrease a ratio of the bottom-blown oxygen because of which decrease a high post combustion rate can be obtained, and furthermore, it can contribute to remove such undesirable factor as restraining the dephosphorization reaction from progressing, which undesirable factor occurs due to such phenomenon as the carbonaceous material injected from the bottom of the converter does not dissolve in the bath and enters the slag to thereby cause the reducing reaction of FeO contained in the slag.

Consequently, a stable dephosphorization can be performed.

The angle of the spiral movement-imparting member in this case is preferably to be in a range of 10° to 40°, and more preferably 15° to 30°.

WORKING EXAMPLES

A more detailed explanation is made below with reference to the working examples.

Example 1

Pig iron of 32 tons shown in Table 2 was charged into a converter (provided with a lance for top-blowing oxygen and three triple pipe tuyeres) in which a hot heel of 60 tons shown in Table 2 which was made to remain in the converter in a prior process was present, and the former was melted. Then, steel scrap of 31 tons was again charged and melted so that molten iron of 120 tons was produced. In this melting fine particles of anthracite was injected by a required quantity at an average amount of 20 t/hr by using an $N_2$ gas as a carrier gas from the inner pipe of each of the three triple pipe tuyeres. In addition, oxygen of 17% in amount with regard to the overall volume of the oxygen was straight introduced through a space defined between the inner pipe and the intermediate pipe, and propane of about 10 vol % in amount of the bottom-blown oxygen was introduced through another space defined between the intermediate pipe and the outer pipe. The rate of all of the oxygen introduced was 18,000 $Nm^3$/hr. After elapsing 3 minutes from the commencing of the melting, the generated dust from prior heat was added at a speed of 100 kg/min in 38 minutes. The amount of dust was 32 kg/t-molten pig iron.

Figure 11:
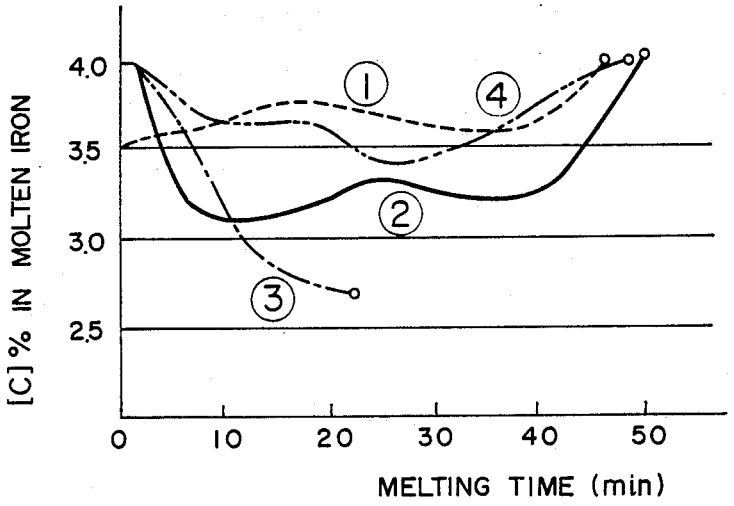
FIG. 11 is a graph illustrating changes in [C] in the molten iron in the example of the invention and a comparative example.

On the other hand, 3500 kg quick lime used as a flux was introduced at the initial stage of the melting. The slag after melting showed $CaO/SiO_2$, of 2.08, and the percentage of FeO was 3.9%. The post combustion rate was able to be controlled in a range between 25 to 30% by changing the lance height in accordance with change in the post combustion rate during the operation. The operating period of time was about 45 minutes. The content of [C] during the melting was able to be controlled in a range between 3 to 4% as shown by the curve 1 shown in FIG. 11, and a good operation was performed. The compositions and the temperatures are shown in Table 2, in which a satisfactory level of the phosphorous content was obtained.

TABLE 2

| | Temperature °C. | Composition % | | |
|---|---|---|---|---|
| | | [C] | [P] | [Si] |
| Hot heel | 1350 | 3.50 | 0.053 | 0.03 |
| Cold pig iron | Room temperature | 4.48 | 0.102 | 0.56 |
| Scrap | Room temperature | 0.12 | 0.025 | 0.15 |
| Molten iron after melting | 1380 | 3.90 | 0.015 | 0.03 |
| Molten iron before tapping | 1400 | 3.95 | 0.016 | 0.02 |

Example 2

Steel scrap of 31 tons shown in Table 3 was introduced into a converter (provided with lance for top-blowing oxygen and three triple pipe tuyeres) in which a hot heel of a prior heat of 60 t shown in Table 3 was present, and the same steel scrap of 31 tons was again introduced and melted, so that molten iron of 120 t was produced.

In this melting, fine particles of anthracite was introduced by a required quantity at an average of 20 t/hr by using an $N_2$ gas as a carrier gas through an inner pipe of the three triple tuyeres. In addition, oxygen of a quantity of 13% of the overall volume of the oxygen was introduced through a space defined between the inner pipe and the intermediate pipe with a spiral movement being imparted to the oxygen (angle of the spiral was 30°), and propane of a quantity of about 10 vol % of the bottom-blown oxygen was introduced through another space defined between the intermediate pipe and the outer pipe. The rate of the oxygen introduced was 18,000 $Nm^3$/hr. After elapsing 5 minutes from the commencing of the melting, iron ore was added at a speed of 50 kg/min for 40 minutes. The amount of iron ore used was 17 kg/t-molten iron.

On the other hand, lime of 3100 kg and fluorite of 200 kg were introduced at the initial stage of the melting as a flux. The slag during the melting showed $CaO/SiO_2$ of 1.97, the percentage of FeO 3.6%, and an excellent fluidity. The post combustion rate was able to be controlled in a range between 24 to 28% by adjusting the lance height in accordance with change in the post combustion rate during the operation. The operating period of time was about 50 minutes. By adjusting the injection speed of carbonaceous material, a percentage of [C] in the bath was controlled to be in a range of 3.0 to 4.0% as designated by the curve 2 shown in FIG. 11 during the melting period. In the curve 2, the initial content of [C] in the bath is an initial value of the hot heel. The controlling of the [C] in the bath is effected in accordance with a [C]-controlling model in which such factors as the amount of introduced carbonaceous material, the degree of decarburization calculated with an exhaust gas analysis, and effect of dilution of [C] in the molten iron which dilution is based upon a scrap-melting model are taken into consideration.

As a result, no slag foaming was observed.

The temperature and the result of analysis of the composition of the molten iron concerning each of two stages, that is, after the melting and before the tapping are shown in Table 3, wherein "after the melting" means a value obtained by sampling and measuring the temperature with a sub-lance at the five minutes before the tapping. The phosphorous level was lowered to a level which needs no dephosphorization in the decarburizing furnace in the second stages.

TABLE 3

| | Temperature °C. | Composition % | | |
|---|---|---|---|---|
| | | [C] | [P] | [Si] |
| Hot heel | 1370 | 3.98 | 0.061 | 0.03 |
| Scrap | Room temperature | 0.20 | 0.024 | 0.18 |
| Molten iron after melting | 1390 | 3.80 | 0.011 | 0.02 |
| Molten iron before tapping | 1405 | 4.01 | 0.012 | 0.03 |

Comparative Example 1

The number of triple pipe tuyeres provided in the furnace bottom was increased up to six, and the rate of the bottom-blown oxygen was made to be 30%. Other conditions were made substantially the same as those of working example 1 to thereby effect the melting. The change of [C] during the melting was designated by a curve 4 shown in FIG. 11. As can be clearly seen therefrom, the post combustion rate was able to be controlled from 25 to 28%. Although the slag composition was $CaO/SiO_2$ of 1.83, the percentage of FeO was 1.5% which is a low value. Therefore, the rate of phosphorous after the melting was higher than that obtained in Working example 1.

Consequently, lower dephosphorization was a problem.

Comparative example 2

Melting was performed under the substantially similar conditions as those for Working example 1. In this melting, [C] of a molten iron was lowered as designated by the curve 3 shown in FIG. 11 by slightly decreasing the amount of the supplied carbonaceous material with the result that a serious slopping occurred after the elapse of time of 20 minutes from the decreasing, causing for the operation to be stopped. The content of [C] in this state was 2.7%.

As described above, according to the present invention, a cold iron source can be effectively melted at a high post combustion rate by using both a carbonaceous material and an oxygen gas. Furthermore, phosphorous included as an impurity in both the carbonaceous material and a main raw material can be simultaneously removed during the melting by use of a small amount of flux added during the melting. Therefore, dephosphorization operation performed at the second stage in which both decarburizing and refining are effected can be omitted or can be mitigated in degree. Consequently, the present invention will greatly contribute to the melting of a cold iron source.

What is claimed is:

1. A method of melting an iron-containing cold material and simultaneously obtaining a low phosphorous and high carbon molten iron while maintaining a high post combustion rate, comprising the steps of:

preparing a converter having a lance for top-blowing oxygen, and a bottom-blowing triple pipe nozzle disposed at a bottom of the converter which nozzle is provided with an inner pipe, an intermediate pipe and an outer pipe;

supplying the iron-containing cold material into the converter in which a hot heel exists;

introducing into the converter all of a carbonaceous material together with a non-oxidizing gas through the inner pipe of the triple pipe nozzle, oxygen through a space defined between the inner pipe and the intermediate pipe, and a non-oxidizing cooling gas through another space defined between the intermediate pipe and the outer pipe, and additional oxygen through the oxygen top-blowing, lance so that the cold material is melted into a molten iron under an existence of slag;

maintaining both the content of carbon dissolved in the molten iron at a level of 3 to 4% in most of a period of time for the melting and the rate of bottom-blown oxygen in a range of not less than 10% but less than 20% of the total amount of the oxygen; and adding intermittently or successively iron oxide into the slag in most of a melting period of time while keeping a slag basicity defined by $CaO/SiO_2$ in a range of 1.5 to 3.0.

2. A method according to claim 1, wherein oxygen blown from said triple pipe nozzle is introduced in a state of a spiral flow into said molten iron.

3. A method according to claim 1, wherein $CaF_2$ is partially used a material for promoting the generating of the slag together with lime.

4. A method according to claim 1, wherein iron ore, pellet, ore containing Mn, milscale, sintered ore, and which may be dust generated in said converter are used as iron oxide.

5. A method according to claim 2, wherein a spiral movement is imparted to the bottom-blown oxygen by a spiral guide element provided in said triple pipe nozzle and arranged to have a spiral angle of 10° to 40°.

6. A method according to claim 1, wherein iron oxide is added to the slag at a rate of 10 to 100 kg per ton of molten iron.

7. A method according to claim 1, wherein the amount of phosphorous in the molten iron after melting is 0.02% or less.

* * * * *